US007263852B2

(12) United States Patent
Bacchus

(10) Patent No.: US 7,263,852 B2
(45) Date of Patent: Sep. 4, 2007

(54) HEAT EXCHANGER APPARATUS AND METHOD FOR EVAPORATIVE COOLING REFRIGERATION UNIT

(75) Inventor: Rockney D. Bacchus, El Paso, TX (US)

(73) Assignee: Freus, Inc, Vinton, TX (US)

( * ) Notice: Subject to any disclaimer, the term of this patent is extended or adjusted under 35 U.S.C. 154(b) by 225 days.

(21) Appl. No.: 10/930,311

(22) Filed: Aug. 30, 2004

(65) Prior Publication Data

US 2006/0042294 A1 Mar. 2, 2006

(51) Int. Cl.
*F28D 5/00* (2006.01)

(52) U.S. Cl. ..... 62/305; 62/91

(58) Field of Classification Search ..... 62/305, 62/314, 91, 272, 428
See application file for complete search history.

(56) References Cited

U.S. PATENT DOCUMENTS 3,911,060 A * 10/1975 Bradley et al. ..... 261/27
4,182,131 A 1/1980 Marshall et al.
4,353,219 A * 10/1982 Patrick, Jr. ..... 62/183
4,603,559 A 8/1986 Wu
4,619,317 A * 10/1986 Disselbeck et al. ..... 165/162
5,832,739 A 11/1998 Bacchus
5,992,171 A 11/1999 Bacchus
6,338,256 B1 1/2002 Tien
6,345,514 B1 2/2002 Moon et al.
6,463,751 B1 10/2002 Teller
6,595,011 B1 7/2003 Forgy

* cited by examiner

*Primary Examiner*—Melvin Jones
(74) *Attorney, Agent, or Firm*—Charles W Hanor; Hanor & Guerra

(57) ABSTRACT

This invention is for a highly efficient heat transfer unit and method for heat transfer for an air conditioning refrigeration unit. The invention has a plurality of condenser coils that stand generally vertically upright (with up to 20° tilt to optimize downward water flow with air being pulled across) between a splash louver and an evaporative fill material. The evaporative fill material and the splash louver transfer heat from the water by air cross flow to make the air conditioning unit very efficient and reduces the amount of copper coils needed. The condenser coils are cooled by water flowing down through them and into a sump. The condenser coils are also cooled by air pulled across them by a fan mounted on the top of the air conditioning unit. The sump in the bottom of the unit has a wall that directs the water in it to a water pump that then sends the water to the water distribution pipe. The water pipe covers the water distribution member with water, which then allows the water to flow down the condenser coils. The large amount of heat that is transferred from the condenser coils to the water and the air cross flow is what enables the air conditioning unit to be so efficient. A low pressure drop of refrigerant in the condensing coils, the large surface area, and horizontal air flow also helps the air conditioning unit to be efficient.

19 Claims, 15 Drawing Sheets

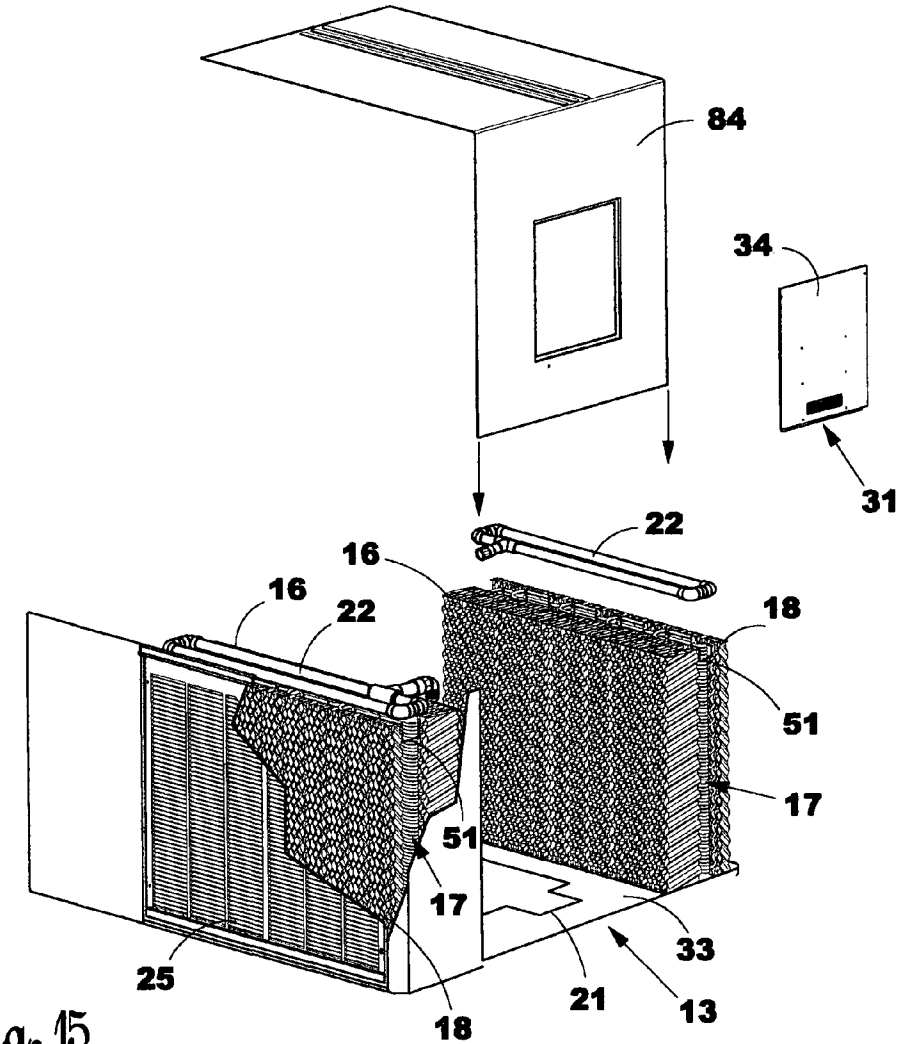
Fig. 15
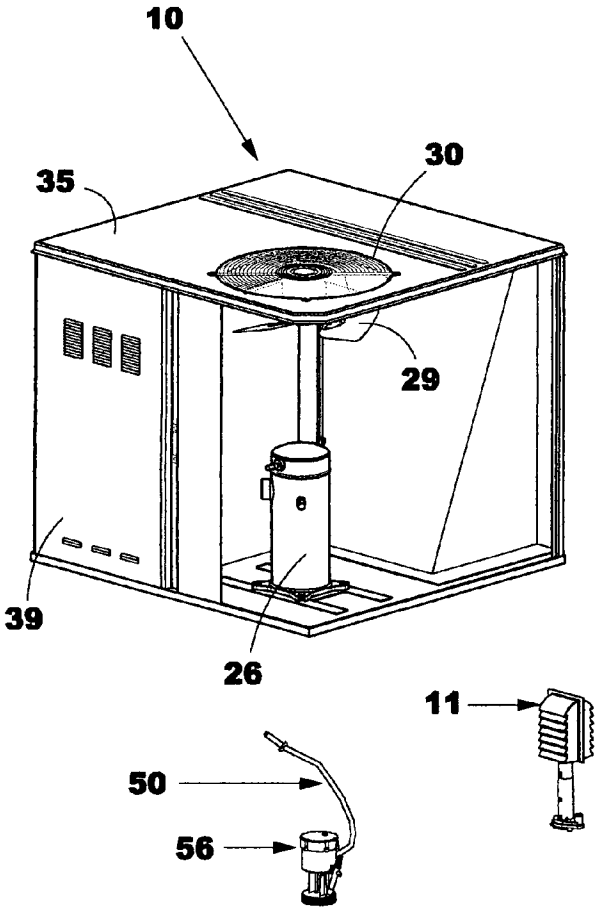

HEAT EXCHANGER APPARATUS AND METHOD FOR EVAPORATIVE COOLING REFRIGERATION UNIT

CROSS-REFERENCE TO RELATED APPLICATIONS

None

STATEMENTS REGARDING FEDERALLY SPONSORED RESEARCH OR DEVELOPMENT

None

REFERENCE TO A MICROFICHE APPENDIX

None

BACKGROUND OF THE INVENTION

1. Field of the Invention

The invention relates to a water cooled air conditioner having a heat exchanger for an air conditioner refrigeration unit using water and air to cool the hot refrigerant in the condenser coils and a method for transferring heat from said condenser coils.

2. Description of the Related Art

In prior art air conditioners the condenser coils have been typically cooled in an air conditioner refrigeration system by pulling ambient air across the condenser coils with a fan inside the unit. The problem with these units is that they can be relatively inefficient in cooling the condenser coils, particularly as the ambient temperature rises. As the ambient temperature rises the efficiency rating goes down. When the ambient temperature is very hot, the efficiency rating of a high efficiency air conditioner may be no better than a standard air conditioner with an efficiency rating in the order of only 10.

Most air conditioning units for homes and small businesses are typically air cooled by blowing air over the condensing coils. For small commercial buildings, these units may be self contained units that include both the compressor, evaporator coils and condensing coils in the unit. These types of unit may be typically mounted on the roof of a building with the feed outlet of each unit connected to the feed ducting and a return air inlet connected to the return air ducting for a particular zone. Typically an air cooled condenser can lose 20% of its capacity as the outdoor temperature increases from 70° F. to 100° F. as compared to only about 4% for this invention.

It is known to improve the efficiency of the air conditioner units cooling of the condenser coils by running water over the coils instead of just air flow. After the water has run over the condenser coils and transferred heat from the coils to the water, it can be recirculated for continued cooling. After the water was cooled it was once again passed over the condenser coils. For very large air conditioning systems for large facilities it is common to use cooling towers with water recirculation to provide for removal of heat from the condensing unit to provide cooling.

U.S. Pat. No. 6,595,011 is a water cooled air conditioner. In this prior art, a water pump delivers water from the water tank through one or more water sprinklers into the inlet duct. A fan draws air into the inlet duct and through the air, which results in evaporation of the water and cooling of the air. The water of the water tank is maintained by a water valve and float. The compressor, the condenser coil and the accumulator are submerged in a body of water wherein the temperature of water is controlled by evaporative cooling.

U.S. Pat. No. 6,463,751 is an air conditioning unit that uses the condensate water to cool the condenser coil. Condensate from the evaporator is allowed to drip on the condenser coil itself, and this may be done by a trough at the top of the unit to direct the condensate. Also, U.S. Pat. No. 6,345,514 uses the condensate to cool the condenser. In this invention the condenser is on the outside of the compressor and there is a condensate distributor on top of the condenser to evenly distribute condensate over the condenser for cooling.

In another prior art invention, U.S. Pat. No. 6,338,256, special water cooling disk are installed in the center of a hollow heat exchange unit. The heat exchange unit formed by the refrigerant tubes and heat radiating fins that are installed upright in the unit. The one or more water cooling disk have water dripped on them and then the inertia of the rotation of the disk sprays the water onto the heat exchange unit and then the water runs down the unit.

It is known in the prior art to cool the water supplied to condenser coils in such systems adiabatically by circulating the water through an evaporative fill medium and then circulating the water in heat exchange relationship with the condenser coils. Ambient air is circulated through the evaporative fill medium while the water flows through the medium to thereby cool the water to a temperature approaching wet-bulb temperature before the water is supplied to the condenser coils. The water is then recirculated to the evaporative fill medium to effect cooling of the water in the manner just described. Because of evaporation, make-up water is automatically supplied to maintain an appropriate level of water in the system. Water heat exchangers are described, for example, in U.S. Pat. Nos. 4,182,131 and 4,603,559.

In the Bacchus U.S. Pat. No. 5,832,739 and Bacchus U.S. Pat. No. 5,992,171 the condenser coils are cooled by being covered with water in a channel on the bottom of the unit. The water was first cooled by a fan pulling air across the water as the water flowed down through an evaporative fill material, and when the water reached the end of the evaporative fill material it ran into one or more continuous serpentine channels, where the condenser coils were located

BRIEF SUMMARY OF THE INVENTION

This invention is to improve the heat transfer from and cooling of condenser coils in an air conditioner refrigeration unit. The condenser coils in this invention are positioned vertically upright at one or more sides of the air conditioning unit. The condenser coils have an evaporative fill material in front of or behind them, and the evaporative fill materials are adjacent the condenser coils. Water is distributed across the top of the condenser coils into a water distribution member. Water travels through a plurality of holes in the water distribution member and then flows down in contact with the condenser coils to provide enhanced heat transfer until it reaches support ledge channels. From the channels the water travels into a sump, and then into a pump that redistributes the water into the water distribution member.

As the water travels down the condenser coils ambient air is pulled across by a fan to further cool the condenser coils and evaporate some water to provide cooling. The evaporative fill in front of or behind the condenser coils also help to cool the coils by directing the air flow through and on to the condenser coils. The evaporative fill also cools the water to provide cooler water to the sump, which in turn provides better heat transfer from the coils to the water.

The sump has a float that is attached to a water valve that will replenish the water level in the sump if it falls below a certain level. The water that is in the sump may also be further cooled by the air pulled into the air conditioner refrigeration unit and across the water in the fill by the fan. The sump has a channel that directs the water to the intake region for the water pump so that the pump can redistribute the water. The sump is periodically drained to help minimize solids buildup in the sump due to evaporation of the water during cooling.

BRIEF DESCRIPTION OF THE SEVERAL VIEWS OF THE DRAWINGS

FIG. 15 shows a view of air conditioner system with a double inlet setup or multiple sections linked together of splash louver, condenser coils, and evaporative fill material

DETAILED DESCRIPTION OF THE INVENTION

Figure 1:
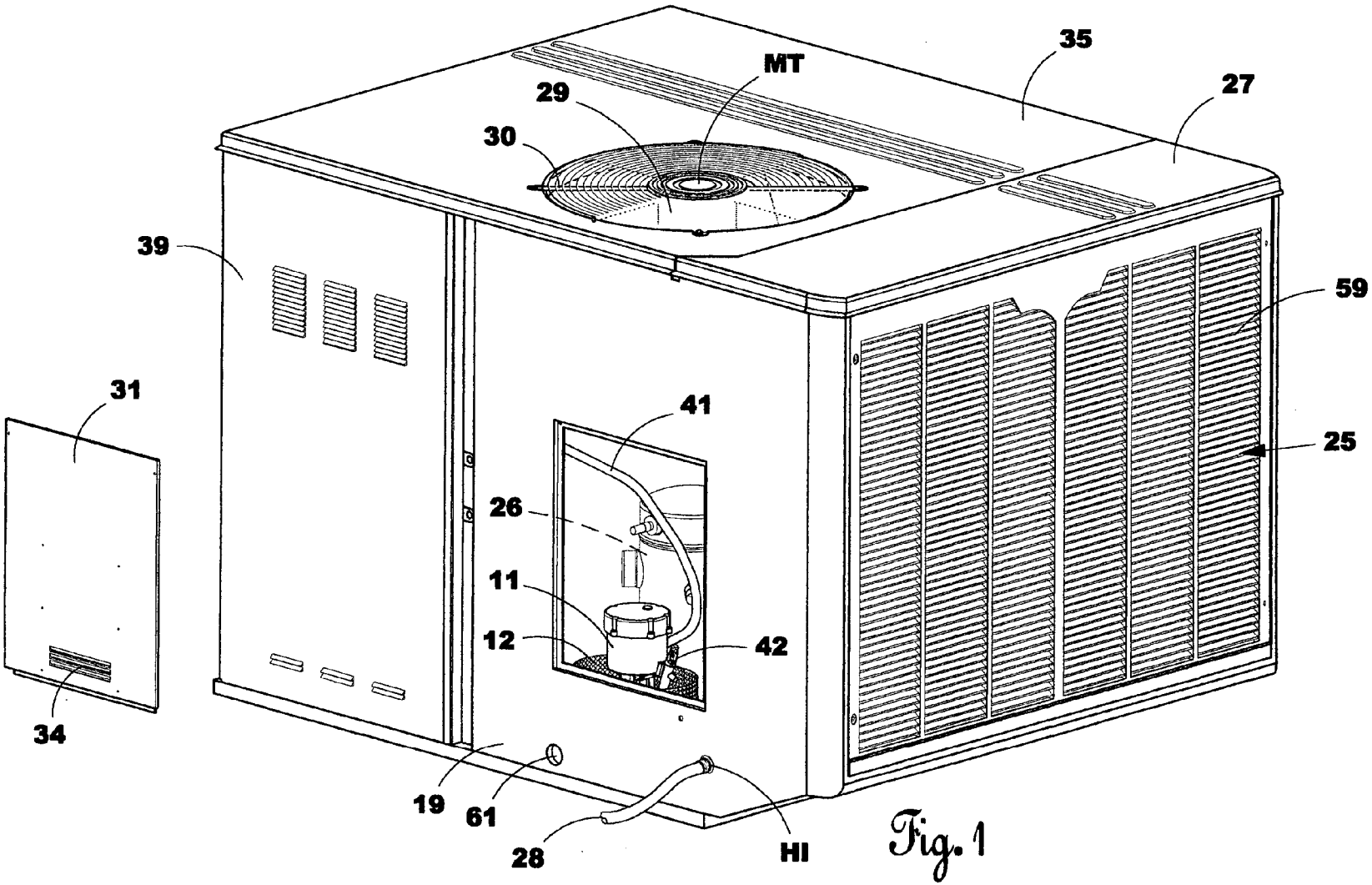
FIG. 1 is an overall view of air conditioning unit means for this invention

The invention includes an air conditioning unit means 10 (FIG. 1). The operation of water cooled air conditioners is disclosed in detail in my U.S. Pat. No. 5,832,739 and U.S. Pat. No. 5,992,171 which are incorporated here in by this specific reference thereto.

An embodiment of the invention is accomplished by retrofitting an existing air conditioning unit with the water cooled condenser components and to the specifications set out below. For example a standard York brand air cooled air conditioning unit may be used by removing the standard air cooled condensing coils of that unit and then substituting the water cooled condenser components of this invention. This enables the use of a mass produced standard air conditioning unit rather than constructing a new unit from the ground up to greatly reduce costs. Furthermore, repair persons are familiar with the standard air cooled unit and only need to also learn the added water cooled condensing components. After the components of this invention are added to the existing unit the electrical system, the refrigerant flow pipes from the compressor (of existing unit) to the condensing coils (of this invention), and the refrigerant flow pipes from the condensing coils (of this invention) to the evaporator unit (of existing unit) will need to be connected according to known air conditioning practices. The components of this invention and the matter in which the condensing components are cooled make air conditioning unit means 10 of this invention highly efficient. A constant flow of water travels down the condensing components, to keep the condensing components cool during the operation, and thus increase the efficiency of air conditioning unit means 10. Once the water cooled condensing components are added to the standard air cooled unit you have a new air conditioning system that looks and performs like an integral unit.

In FIG. 1 the top of air conditioning unit means 10 is made up of main top portion 35 and front top portion 27. Fan 29 is mounted in the front left corner of main top portion 35, by way of top grill 30 at reference point MT. The left side of air conditioning unit means 10 extends down from main top portion 35 and front top portion 27. The left side comprises rear left wall 39 and front left side wall 19, that extend vertically from the bottom of air conditioning unit 10 to the top. In FIG. 1, panel 31 of front left side wall has been removed to make it possible to see the location of water pump means 11 and compressor 26 (in hidden lines) in location to fan 29 on main top portion 35 and front side wall 19. On side plate 31 there are slots 34 to allow air to enter air conditioning unit means 10 and cool water pump means 11 with air that has not been saturated with moisture such as the air that comes through louver intake 25. Outside water supply line 28, supplies water to the cooling system of air conditioning unit means 10 through the bottom front of front left side wall 19 and is located at reference point HI. Louver intake 25 makes up the front wall of air conditioning unit means 10 and extends down from front top portion 27 and horizontally from front left side wall 19.

Figure 2:
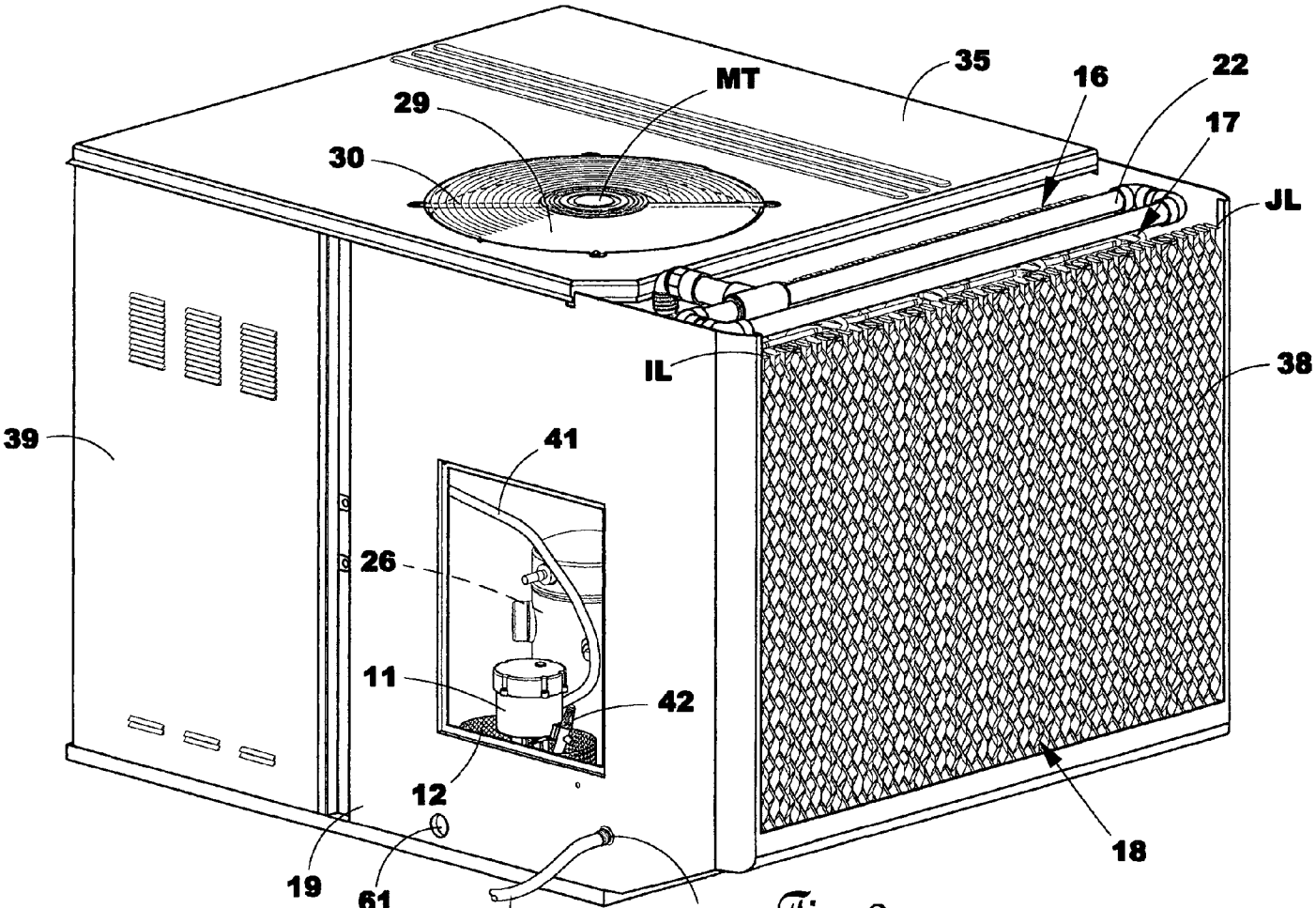
FIG. 2 shows a view of air conditioner system with front top portion and side panel removed so can see water pump, splash louver and water pipe in accordance with the invention FIG. 3 has the splash louver removed so can see coils and evaporative fill material

In FIG. 2 front top portion 27 and louver intake 25 have been removed to show the location of additional parts of the air conditioning unit means 10. Splash louver means 18 is located directly behind louver intake 25, and is made up of vanes 38 that direct the air across condenser coils means 17 in air conditioning unit means 10. It is also possible to see portions of condenser coils means 17 and evaporative fill material 16 which are just behind splash louver means 18. Water pipe 22 is located just in front of main top portion 35 and positioned on top of evaporative fill material means 16 and condenser coils means 17. Splash louver means 18, condenser coils means 17, evaporative fill material 16, and water pipe 22 are all parts of the heat transfer unit of this invention.

Figure 3:
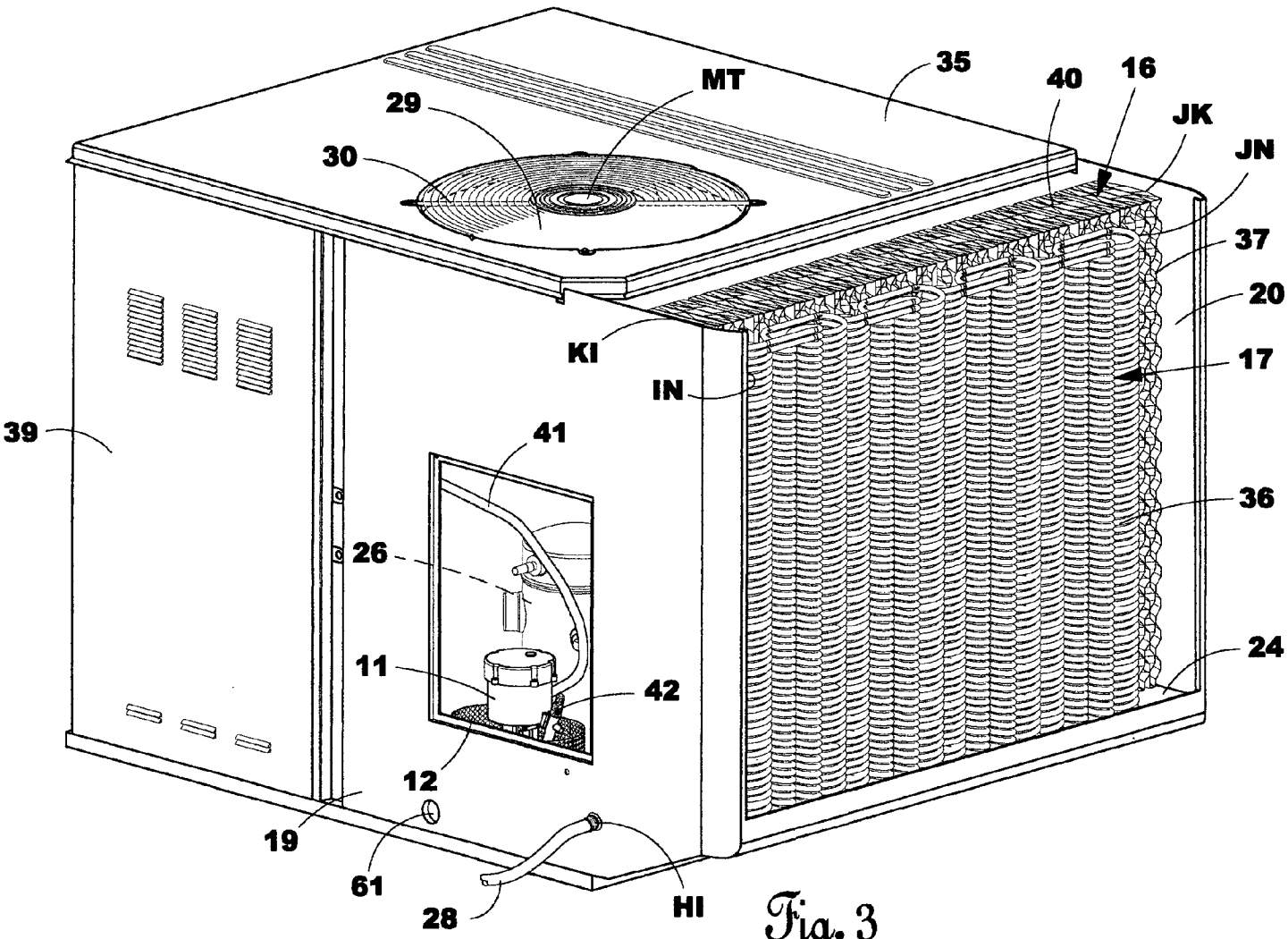

In FIG. 3 two additional items of air conditioning unit means 10 have been removed. The items that have been removed are water pipe 22 and splash louver means 18. With these two items removed it is possible to see condenser coils means 17, condenser pipes 36, evaporative fill material means 16, plastic distribution media sections 40, and flow channels 37. It is also possible to see that evaporative fill material means 16 and condenser coils means 17 are positioned vertically from and supported by fill support ledge 24.

Also in FIG. 3 it is possible to see that condenser coils means 17 are positioned directly in front of and are in physical contact with evaporative fill material means 16.

Figure 4:
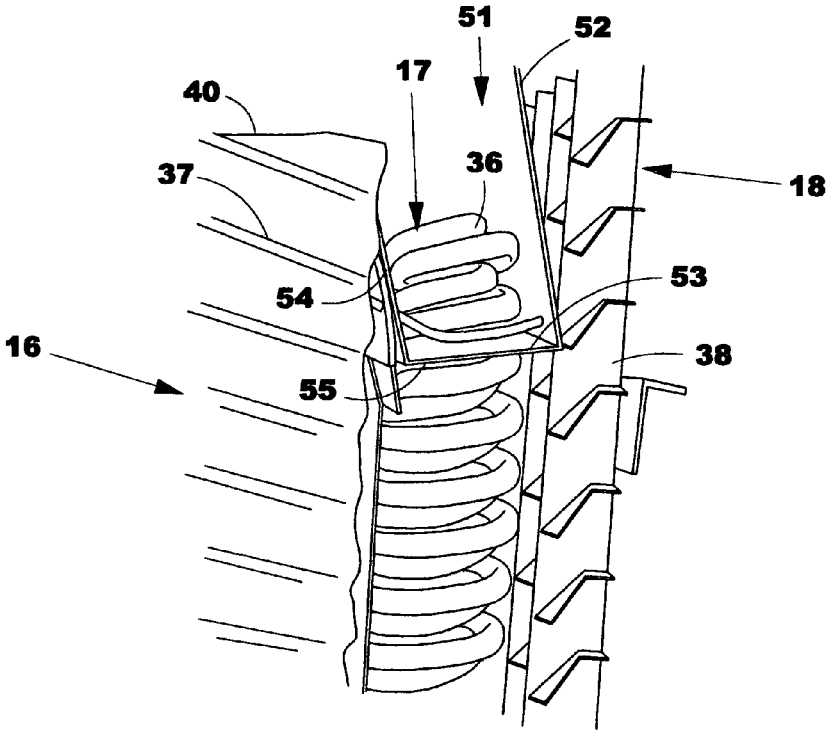
FIG. 4 is a side view of splash louver, evaporative fill material and condenser coils
Figure 5:
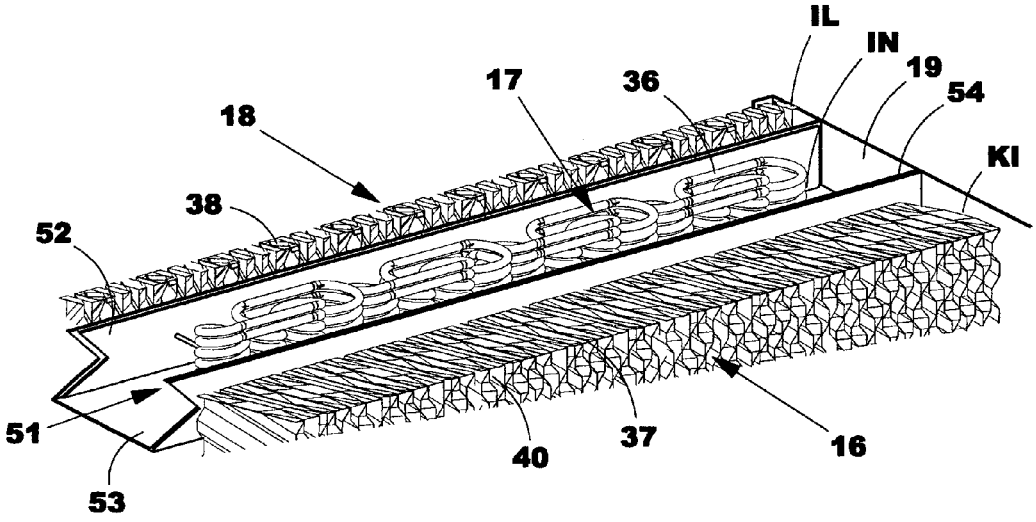
FIG. 5 is a top view of splash louver, evaporative fill material and condenser coils
Figure 6:
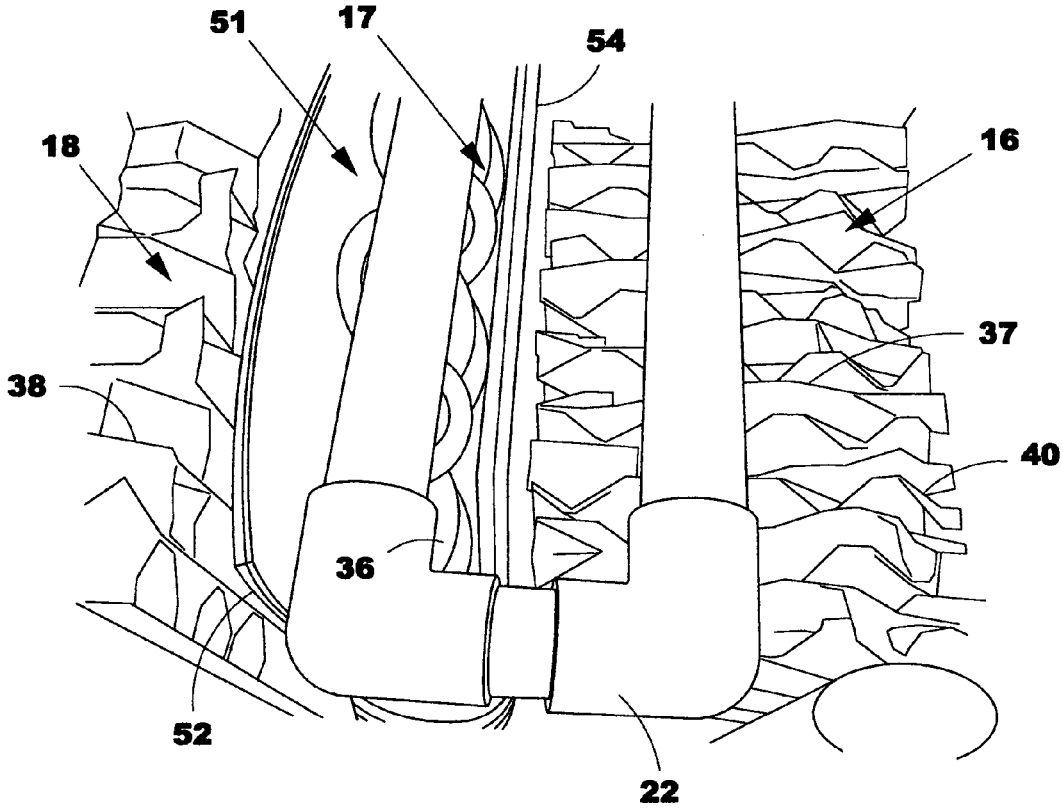
FIG. 6 is a top view of the water pipe, splash louver, evaporative fill material and condenser coils

In FIGS. 4-6, directly behind louver intake 25 is splash louver means 18. Splash louver means 18 is composed of plastic with large openings that allow a large amount of air to be pulled through it with little pressure drop and thereby cool the water. Splash louver means 18 is composed of vanes 38 to return water splashing off from condenser coil means 17 back on to condenser coil means 17. Vanes 38 extend horizontally toward condenser coils means 17 and then angle down to the rear of splash louver means 18 to direct the air down through splash louver means 18 and into condenser coils means 17. Vanes 38 make up the one or more sections that are joined together to form splash louver means 18. After the air leaves splash louver means 18 it is pulled through condenser coils means 17, and evaporative fill material means 16. Splash louver means 18 extends vertically from fill support ledge 24 and fill drain tray means 23 until it is even with the top of right wall 20 at reference point JL (shown in FIG. 8) and front left side wall 19 at reference point IL.

Shown in FIGS. 4-8, condenser coils means 17 are located directly behind splash louver means 18 and are a plurality of vertically oriented condenser pipe 36 that are coiled and intertwined with one another. Each copper condenser pipe 36 is coated to add a corrosion barrier from the water flowing down condenser coils means 17 and from the mineral deposits on condenser coils means 17 from the water. A suitable coating such vinyl, epoxy or phenolic is placed on the copper condenser coils to help inhibit corrosion and release the collection of minerals deposits on the coils which would eventually reduce heat transfer or block airflow. Each copper condenser pipe 36, of condenser coils means 17, is spiraled vertically in a double helix shape. Although copper condenser pipes are preferred other non corrosive materials are suitable. The double helix shape allows the coils to expand and contract with normal operating temperature changes and thereby shed the mineral deposits from condenser coils means 17.

Seen in FIGS. 4-6, condenser coils means 17 are enclosed at the top by water distribution member 51 with front water distribution member wall portion 52, water distribution member portion 53, and rear water distribution member wall 54.

Figure 7:
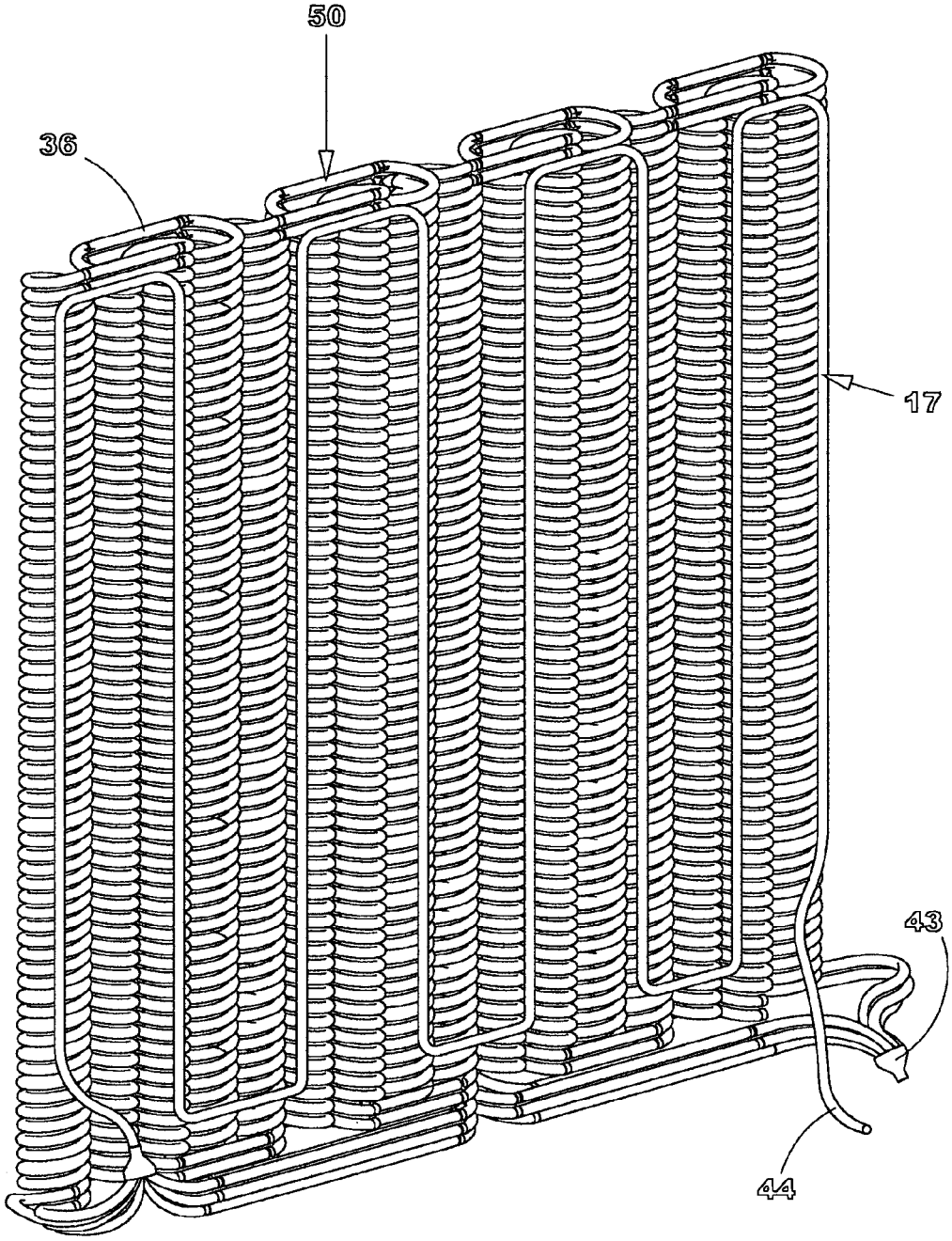
FIG. 7 is a view of the condenser coils

In FIG. 7, each condenser pipe 36 is in a condenser pipe coil pair 50 and its center is offset horizontally from the other condenser pipe 36 center in the pair so that the water flowing down condenser coils means 17 can cover the surface area of each individual condenser pipe 36 and let air flow through them. With the water covering the surface area of each condenser pipe 36, and air being flowed turbulently through them, more heat can be transferred to the water from the condenser pipe 36 and keep condenser coils means 17 cool. Each pair of condensing pipe 36 is placed next to another pair in order to form the plurality of condenser pipe 36 coils in condenser coils means 17.

Figure 8:
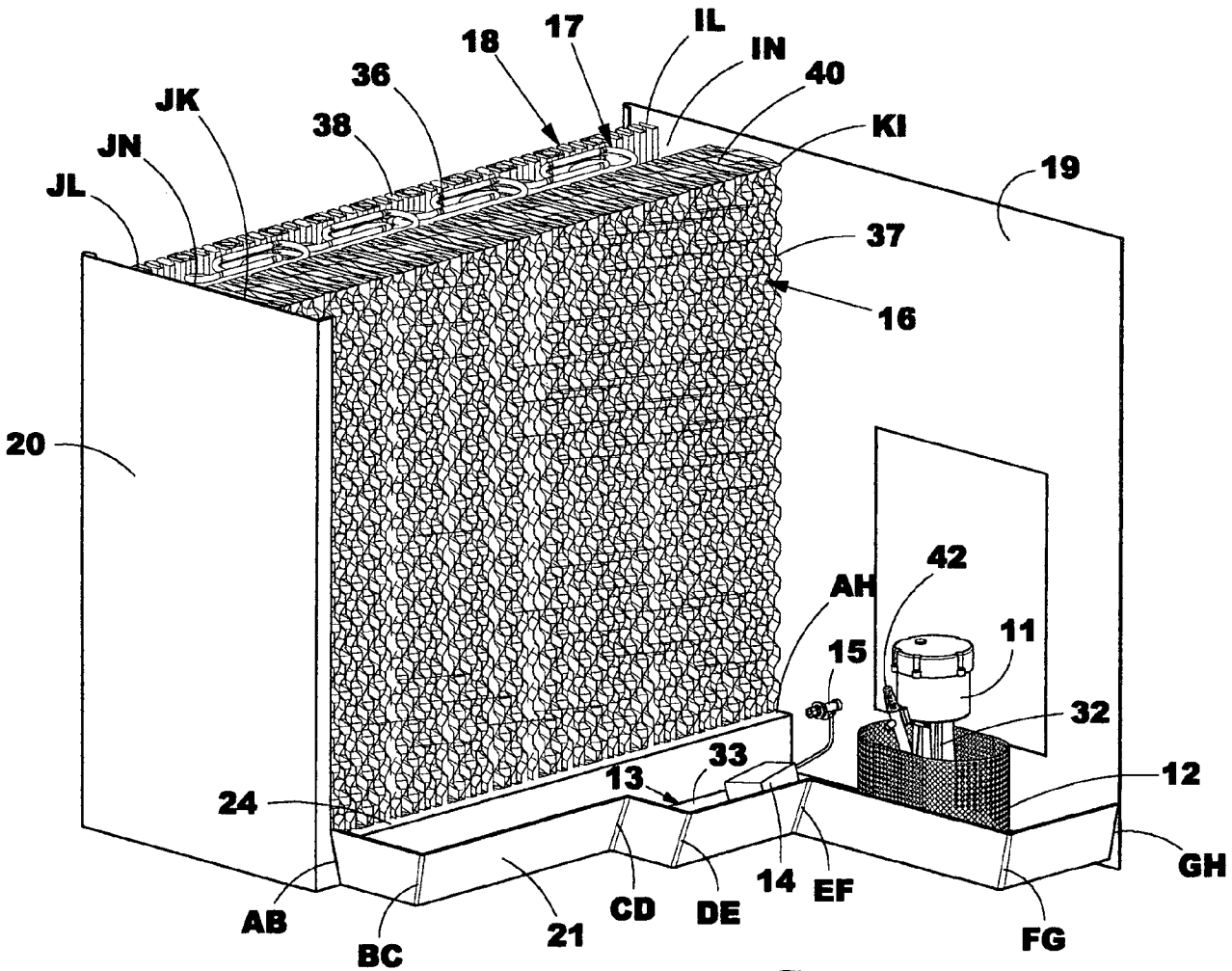
FIG. 8 is a view of the cooling system of an air conditioning system according to this invention

In FIGS. 7 and 8, all condenser pipes 36 are joined together at one end by refrigerant outlet line 44 from compressor 26 at reference point AH (intersection between the rear edge of fill support 24 and front left side wall 19). Condenser pipes 36 are also all connected to one another on the opposite end of condenser pipes 36 by evaporator inlet line 43 (the liquid refrigerant leaves condenser pipes 36 through this line) at the same reference point AH (reference point AH is shown in FIG. 8).

Seen in FIGS. 4-6, water distribution member 51 enables the height of air conditioning unit means 10 to be lower than if spray nozzles were used to cool condensing coils 17. Previously there was a limitation on the way that condenser coils could to be cooled in package units, because there are height requirements for the area used to cool the condenser coils in package units. It was not possible to use spray nozzles to cool condenser coils in package units because the spray nozzles and condenser coils did not fit the height limitation of the package unit. In accordance with this invention, water distribution member 51 now allows condenser coils means 17 (in package units) to be cooled by water flowing down condenser coils means 17 and thereby increase the efficiency of air conditioning unit means 10. Using water for refrigerant heat transfer is much more efficient than using hot air. A gallon of water absorbs about 3,500 times more heat than a gallon of air (per degree of heat added). Since air conditioning unit means 10 is cooled with water it can be more compact and still be more efficient than air conditioning units only cooled by air.

In FIG. 4, evaporative fill material means 16 is oriented directly behind condenser coils means 17 and is composed of vertically upright corrugated plastic distribution media sections 40 that have flow channels 37 running diagonally across them. Every flow channel 37, on a plastic distribution media section 40, in evaporative fill material means 16 runs in the opposite direction from flow channels 37 on plastic distribution media section 40 next to it.

Shown in FIG. 5, the large numbers of corrugated plastic distribution media sections 40 form evaporative fill material means 16 by being mounted on the side of one another and thereby extending transversely across air conditioning unit means 10.

Seen in FIG. 6, flow channels 37 run in two different diagonal directions across plastic distribution media sections 40 to allow the air to travel through evaporative fill material means 16. The large surface area and width of evaporative fill material means 16 allows the air to flow through it and a great amount of heat to be dissipated from the water and condenser coils means 17.

In FIG. 8, condenser coils means 17 and evaporative fill material means 16 extend vertically from fill support ledge 24 and fill drain tray means 23 (shown in FIGS. 10 and 14) almost to the top of front left side wall 19 and right wall 20. Evaporative fill material means 16 stops on right wall 20 at reference point JK (shown in FIG. 8) and on front left side wall 19 at reference point KI. Condenser coils means 17 extends to the same height on both right wall 20 and front left side wall 19 as evaporative fill material means 16 with reference point JN on right wall 20 and reference point IN on front left side wall 19. Condenser coils means 17 and evaporative fill material means 16 stop extending vertically along right wall 20 and front left side wall 19 to allow room for water pipe 22 to have space on top of condenser coils means 17 and evaporative fill material means 16, and still fit below front top portion 27.

Air is pulled by fan 29 from outside louver intake 25 across splash louver means 18, condenser coils means 17, and evaporative fill material means 16. Louvers 59 (shown in FIG. 1) of louver intake 25 angle down and to the front of air conditioning unit means 10 to shed rain and to block sunlight, and louver intake 25 is screened to kept out debris. The air is used to help cool condenser coils means 17 more so than just from the water from water distribution member 51 (FIG. 4). The air coming through the condenser coil means tends to evaporate water on the coil to cool the water and increase heat transfer. It is more efficient to cool the water with air as the coil is warming the water than to do this separately like in conventional cooling towers. After the air is pulled through evaporative fill material means 16, it is sent out of air conditioning unit means 10 and back out to the environment by fan 29 through top grill 30 (shown in FIG. 1).

When the outside air is 95° F., an air conditioning unit with a "dry" or air cooled condenser needs to generate 250 psi while a "wet" condenser (from water flowing down condenser coils means 17) only needs 180 psi to generate the same cooling capacity. The "wet" condenser uses less power to generate the same cooling capacity as a "dry" condenser, therefore the motors and compressor 26 in air conditioning unit means 10 operate at less pressure and temperature and use less power and last longer than air cooled units.

Figure 9:
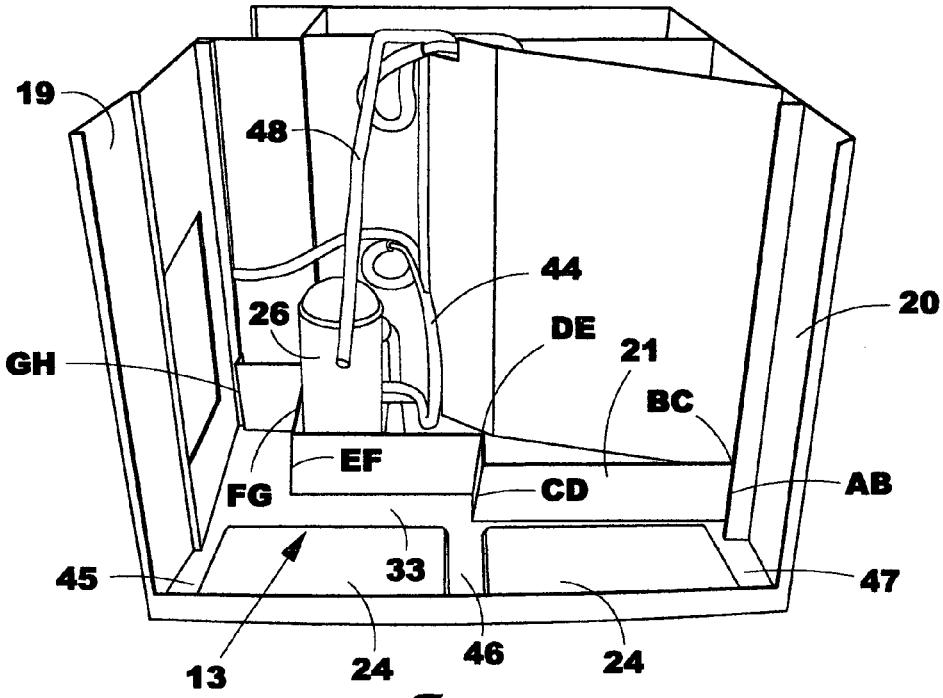
FIG. 9 shows the compressor, sump, support ledge and water channels

In FIG. 9, fill support ledge 24 extends horizontally from the upper portion of sump wall 21 toward the front of air conditioning unit means 10 at reference point AB on the right and reference point AH on the left. Fill drain tray means 23 sits on top of fill support ledge 24 to allow the water from condenser coils means 17 to drain into one or more of fill support ledge channels 45, 46, and 47 (from left to right) of fill support ledge 24. Then from fill support ledge channels 45, 46, and 47 of fill support ledge 24 the water will flow into sump means 13. Splash louver means 18, condenser coils means 17, and evaporative fill material means 16 extend vertically from fill drain tray means 23 and are supported on the left by front left side wall 19, and on the right by right wall 20. Condenser coils means 17 is closely adjacent to both splash louver means 18, and evaporative fill material means 16 to gain better air flow and a great amount of heat transfer and cooling of condenser coils means 17 and maintain the cooling water flowing down the condenser tubing within the space between the two fill material means. Splash louver means 18, condenser coils means 17, and evaporative fill material means 16 are connected together as to give more support to one another, and they all run transversely from front left side wall 19 to right wall 20 of air conditioning unit means 10.

In FIGS. 8 and 9, sump means 13 has a rigid sump wall 21 to direct the water in sump means 13 to water intake screen 12 of water pump means 11. Sump means 13 is made from fiber glass so that it will never rust from the water stored in it. Sump wall 21 starts at reference point AB (the right side of support ledge 24) and extends rearward to reference point BC. At reference point BC sump wall 21 turns to the left (toward front left side wall 19) and extends to the left until reference point CD. At reference point CD sump wall 21 turns and extends rearward to reference point DE. Once at reference point DE sump wall 21 turns again to the left and extends to reference point EF (in the direction of front left side wall 19). From reference point EF sump wall 21 turns once again and extends rearward to reference point FG, and from FG sump wall 21 turns one final time to the left and extends to reference point GH (which is the intersection between sump wall 21 and front left side wall 19.

In FIG. 8, sump floor 33 can either be sloped from fill support ledge 24 to water intake screen 12 or it can be a flat surface. Regardless of whether sump floor 33 is sloped or flat the water will flow to water intake screen 12 and pump intake 32 will pull the water from sump means 13 into water pump means 11. Water pump means 11 is located in sump means 13 between sump wall 21 (from reference point EF to reference point FG) and front left wall 19. Float 14 is connected to water valve 15 and is located in sump means 13. Water value 15 is connected through front left side wall 19 to outside water supply line 28 (shown in FIG. 1). The purpose of float 14 is to make sure that there is enough water in sump means 13 for water pump means 11 to be able to provide water to water pipe 22 and water distribution member 51. The amount of water needed is enough to be able to spread across water distribution member 51, and at the same time have enough water in sump means 13 from the flow of water down condenser coils means 17 to insure that water intake 32 can bring the proper amount of water into water pump means 11 to keep water pump means 11 operational. If there is not a sufficient amount of water in sump means 13 then float 14 will open water valve 15 and water will fill up in sump means 13 to the correct amount. Also a drain plug 61 can be provided at a low point in sump means 13 for draining sump means 13, and drain plug 61 has hose threads that will fit a garden hose, seen in FIG. 1. The position of the plug will be selected to maximize the amount of water that can be conveniently drained from sump means 13.

Figure 10:
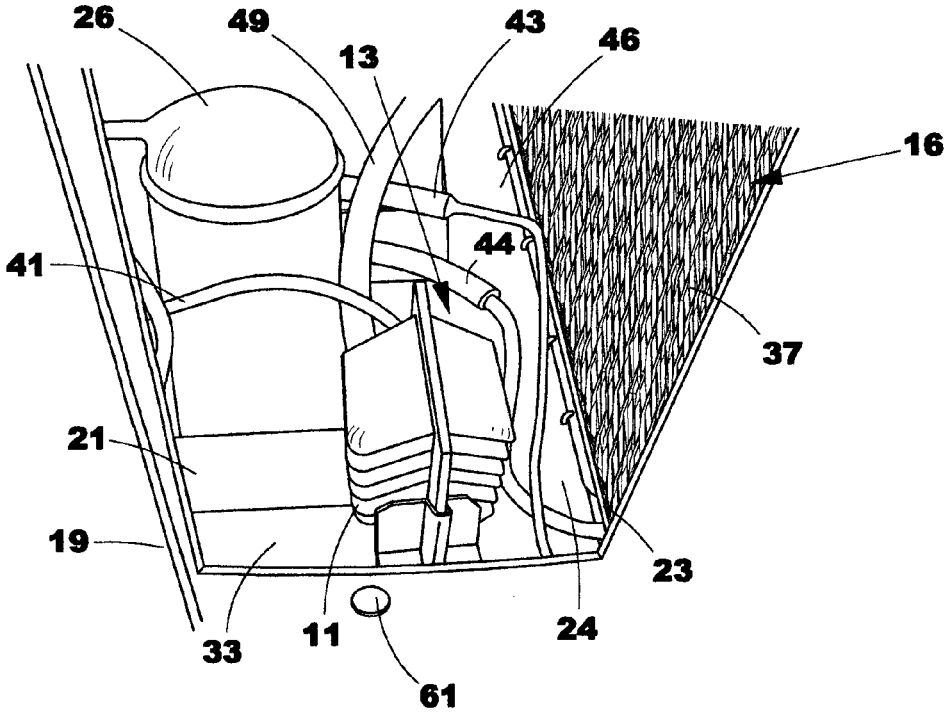
FIG. 10 shows the pump, water supply lines, compressor, and evaporative fill material

In FIG. 8, the water that flows into sump means 13 from condenser coils means 17 is directed to water intake screen 12 of water pump means 11. Water intake screen 12 is a large screened in region around water pump means 11 to keep debris out of water pump means 11. Water intake screen 12 and pump intake 32 supply water from sump means 13 to water pump means 11. In FIG. 10, water supply line 49, of water pump means 11 sends the water to water pipe 22 and then into water distribution member 51 (shown in FIG. 6). Electric cord 41 supplies power to water pump means 11. Once the water is on water distribution member 51, it is evenly distributed to the upper portion of condenser coils means 17 by way of a plurality of contacts 55 shown in FIG. 4 in water distribution member 51 to cool condenser coils means 17.

Figure 11:
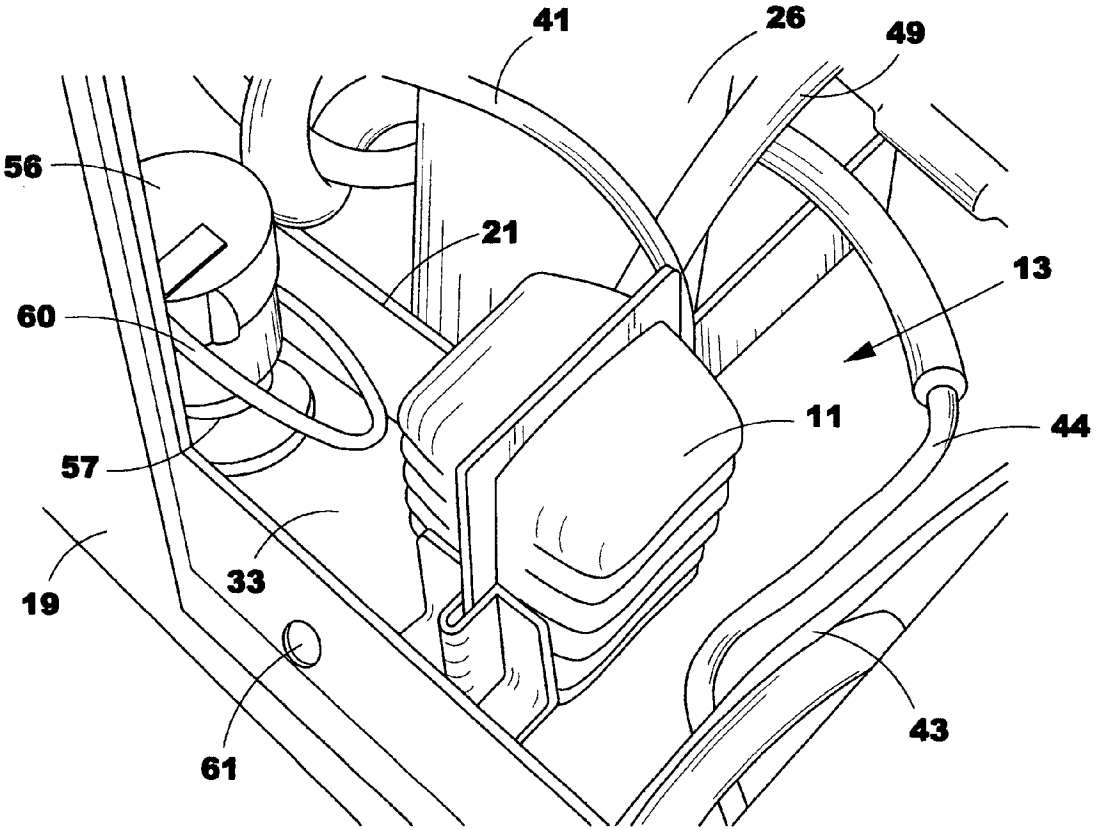
FIG. 11 is a view of the water pump, and flush pump
Figure 12:
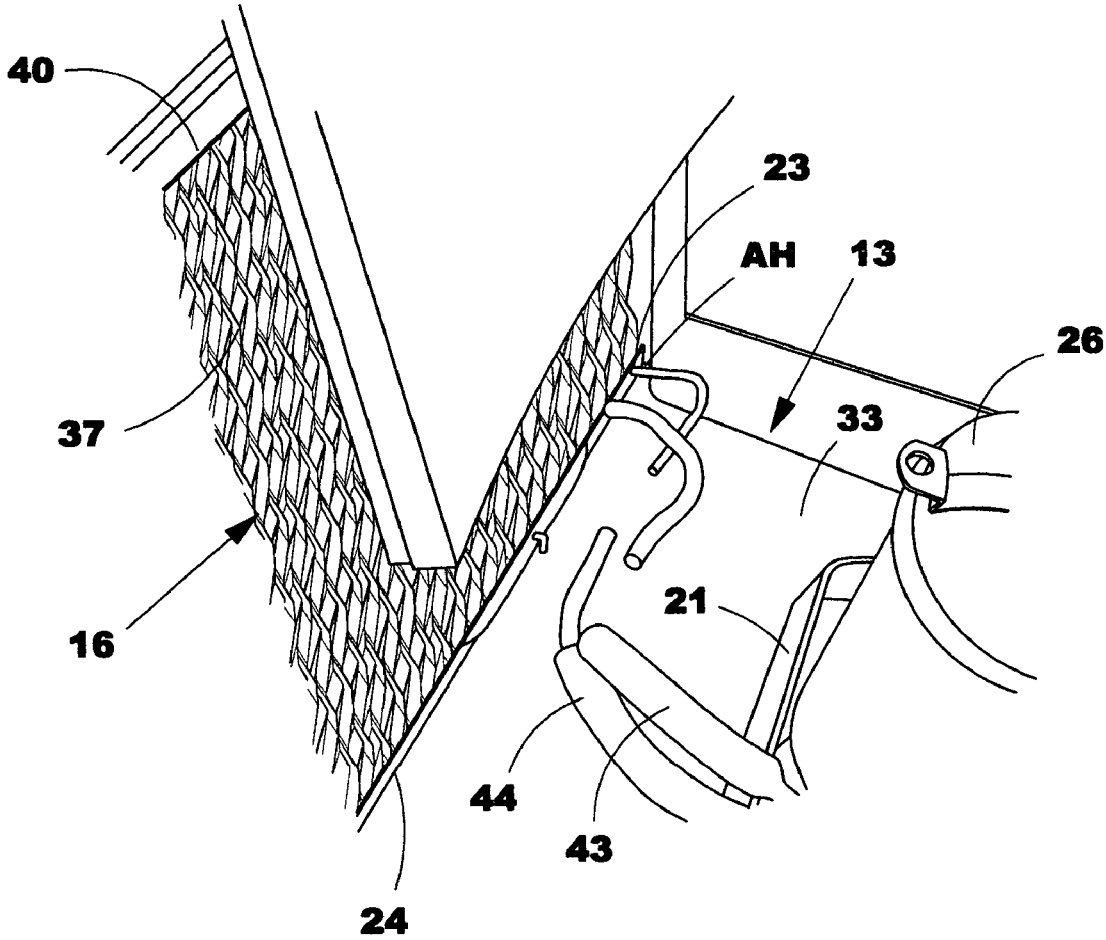
FIG. 12 shows a view of the compressor, sump, evaporative fill, and refrigerant lines

In FIG. 11, a flush pump means 56 is provided to periodically flush sump means 13. As the water evaporates from copper condenser coil means 17 it is replaced. Solids from the evaporated water build up in sump means 13. To help get rid of the accumulated solids flush pump means 56 includes intake region means 57 and a flush line 60, flush pump means 56 is periodically turned on to drain sump means 13 of water and accumulated solids. This reduces the amount of cleaning that is required of condenser coil means 17 and sump means 13.

In FIGS. 9-12, a standard compressor 26 is located behind all of the heat transfer components described above and is part of the original unit that has been retrofitted to make the new unit of this invention. Compressor 26 pushes hot compressed refrigerant to condenser coils means 17 through refrigerant outlet line 44. Refrigerant inlet line 48 supplies circulated refrigerant to the inlet side of compressor 26 from the evaporator outlet line (not shown), in accordance with known refrigeration principles. Copper condenser coil means 17 supplies condensed refrigerant to the evaporator inlet line 43 which then takes the refrigerant to a standard expansion device and evaporator system (not shown) and where the air is cooled and then blown by a standard fan (not shown) into and through the area to be cooled. The complete cycle of the refrigerant in air conditioning unit means 10 is done in accordance with well known refrigeration principles. The air return inlet means and air supply outlet means of the air conditioning unit means 10 are located on the rear panel (not shown) and are connected to ducting through known air conditioning refrigeration principles.

Figure 13:
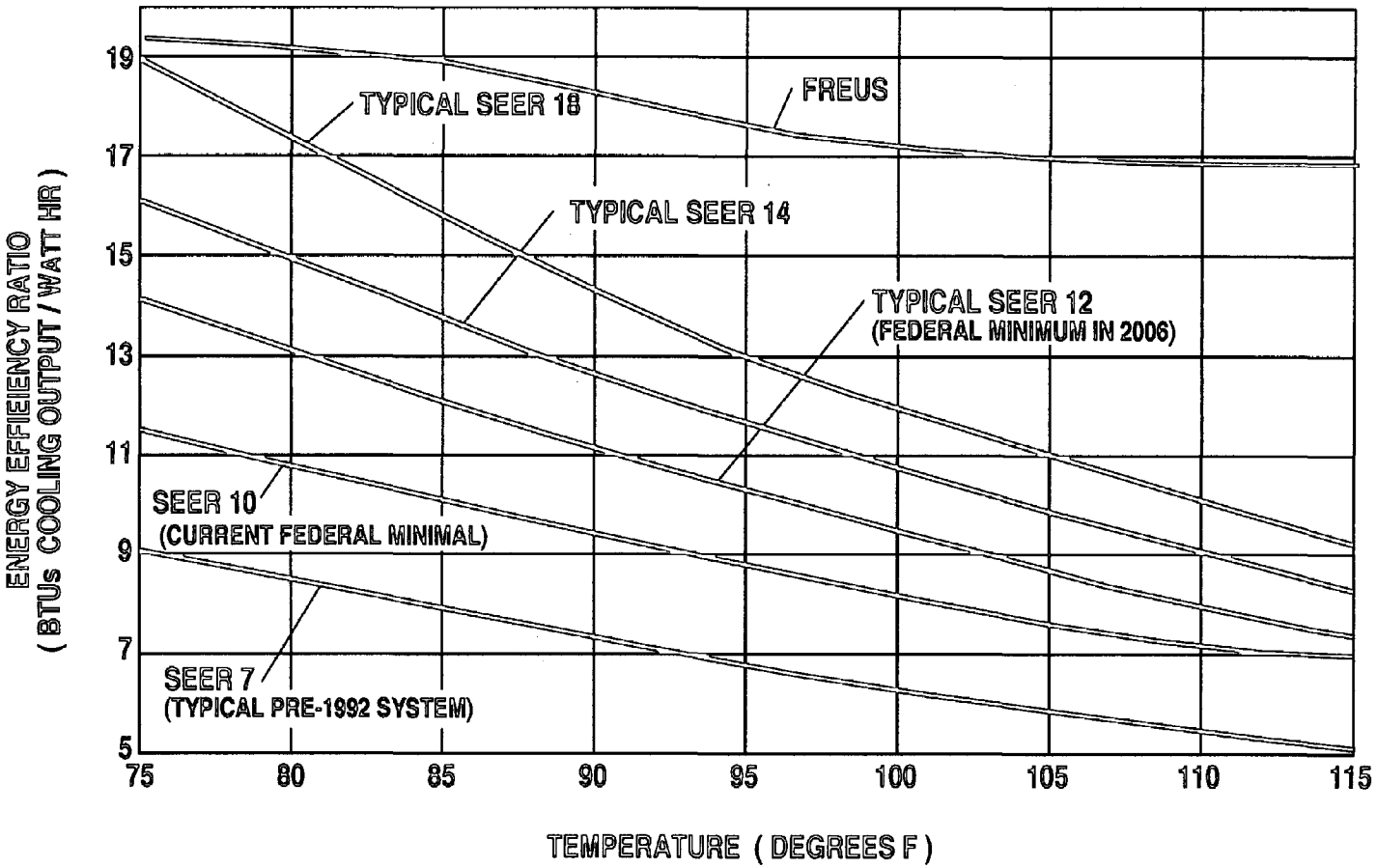
FIG. 13 is a graph of efficiency ratings for air cooled units versus this water cooled invention

FIG. 13 is a graph that shows the typical SEER rated air cooled air conditioning units versus a water cooled unit such as air conditioning unit means 10. The SEER rating is a cooling efficiency standard at lower outside air temperatures (82 degrees) than the EER rating, which is an efficiency rating at higher outside temperature (95 degrees) and this invention air conditioning unit means 10 is on the EER rating standard. The graph measures the energy efficiency ratio (BTUs Cooling Output/Watts Input) depending on the outside temperature while the unit is operating. As one can see from the graph, even the typical SEER 18 unit drastically falls in energy efficiency ratio as the temperature rises during operation. As for this invention, air conditioning unit means 10 it does not drop much at all in its energy efficiency ratio as the outside temperature rises.

Figure 14:
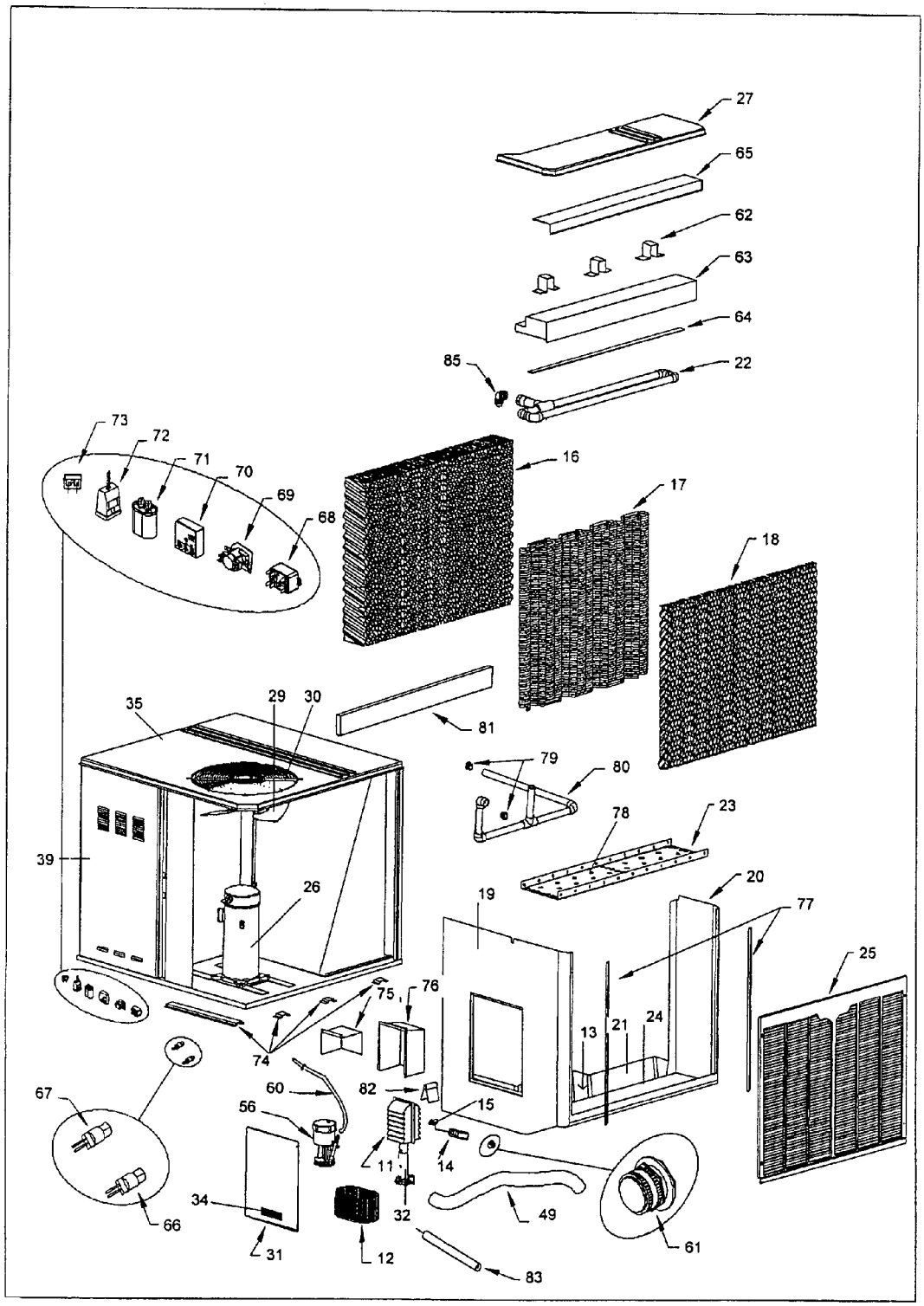
FIG. 14 is an explosion model of the invention

FIG. 14 is an explosion model of air conditioning unit means 10. Starting from the top is top portion 27 and then water support pieces 62, 63, 64, and 65 for water pipe 22. Water supply elbow 85 attaches to water pipe 22 from 49. Next is evaporative fill material means 16, condenser coils means 17, and splash louver means 18. Electrical components 66, 67, 68, 69, 70, 71, 72 and 73 are also shown by rear side panel 39 which covers the location that electrical components 66, 67, 68, 69, 70, 71, 72 and 73 are in air conditioning unit means 10. In the main unit are top grill 30, fan 29 and compressor 26. Support attachments 74 are attached to the main portion of the unit and the heat exchanger section uses support attachments 74 to join with the main portion of the unit. Flush pump means cover 75 and water pump means cover 76 are used to protect flush pump means 56 and water pump means 11. Float spray retainer means 82 prevents water spray from float valve 15 from wetting pump 11. Next to flush pump means 56 is flush line 60. Next you can see float 14 and valve 15 next to drain plug 61, water supply line 49, and magnesium anode 83 to provide sacrificial corrosion protection. Also in FIG. 14 is water intake screen 12 and side plate 31. Heat exchanger portion has front left side wall 19, right wall 20, fill support ledge 24, sump wall 21, and sump means 13. In front of the heat exchanger portion is louver supports 77 and louver 25. Above that is fill drain tray means 23 with drain holes 78. The last portions of the water overflow system are water pipe connectors 79 and water connector pipe 80. Finally there is top of main unit brace support member 81.

There can be multiple coil sections in a single air conditioning unit, such as in larger systems that need to transfer more heat from the condensing coils. There are four possible configurations for the setup of splash louver means 18, condenser coils means 17, and evaporative fill material means 16 described below. The manner in which air conditioning unit means 10 works to transfer heat from condenser coils means 17 does not vary from what has already been described, only the orientation of splash louver means 18, condenser coils means 17, and evaporative fill material 16 to the other components of air conditioning unit means 10 is different for larger systems with multiple coil sections. The process of providing water to cool condenser coils means 17 and the air flow through is still the same for large systems with multiple coil sections as described above for air conditioning unit means 10 with only one coil section, and airflow can be reversed for horizontal discharge. Water pipe 22 and water distribution member 51 are still used as the means to provide water flow down condenser coils means 17 during the operation of air conditioning unit means 10 to make the unit more efficient.

In FIG. 15, it is possible that this invention could be configured to have a double inlet setup. The difference between the double inlet setup and the single inlet as described above is that there are two inlet areas for heat transfer and they are portions of the side walls and not a single inlet area for heat transfer in the front of air conditioning unit means 10 as described above. The double inlet has splash louver means 18, condenser coils means 17, and evaporative fill material 16 in the same orientation as described above. The orientation is where they extend generally vertically from fill support ledge 24, however with double inlet there is a mirror of the inlet section directly on the opposite side of air conditioning unit means 10. This configuration has a new front panel 84 that allows water pump 11 to be cooled with air that is not saturated with water through slots 34 as which is like the description of the invention above. Compressor 26, the evaporative coils and the other components that are not directly associated with heat transfer are between them or are set back from the double inlet area and make up the rest of air conditioning unit means 10.

Another configuration might be that multiple sections are linked together. When multiple sections are linked together there are two or more complete heat transfer areas inside one package that function independent of each other, but are linked to the same overall system. In this configuration there are two sets of splash louver means 18, condenser coils means 17, and evaporative fill material means 16 in the exact same orientation as the double inlet just the two sets are connected together or they are each a part of a separate air conditioning unit.

Figure 16:
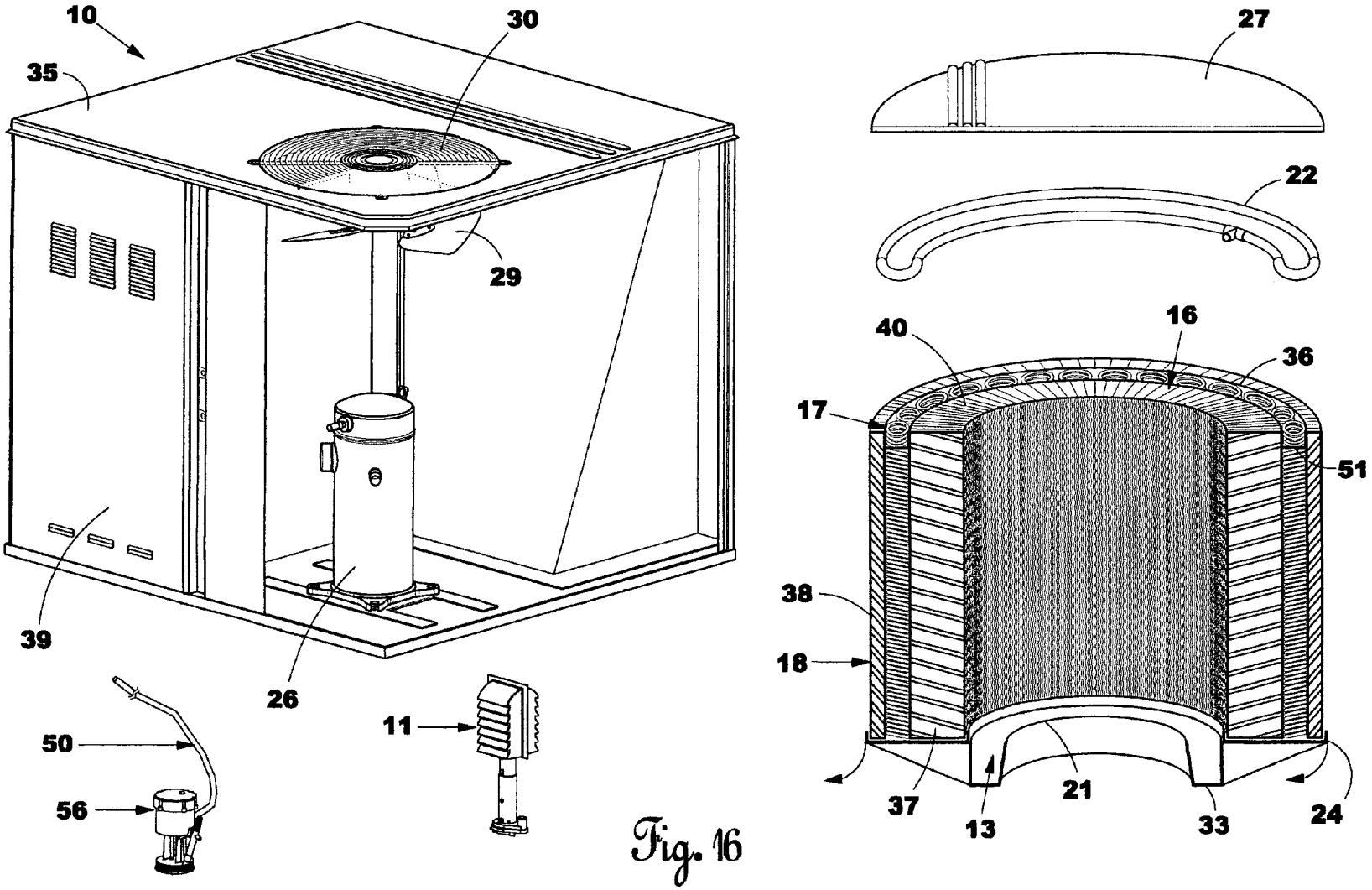
FIG. 16 shows a view of air conditioner system with a horseshoe setup of splash louver, condenser coils, and evaporative fill material

In FIG. 16, it is also possible to have splash louver means 18, condenser coils means 17, and evaporative fill material means 16 form a horseshoe or half round shape. When splash louver means 18, condenser coils means 17, and evaporative fill material 16 are in a horseshoe shape they will extend out from front left side wall 19, make a half circle shape away from air conditioning unit means 10 and then connect with right wall 20 at the other end. The horseshoe shape allows for more surface area of splash louver means 18, condenser coils means 17, and evaporative fill material means 16 which will thereby increase the cooling of the water and condenser coils means 17.

Figure 17:
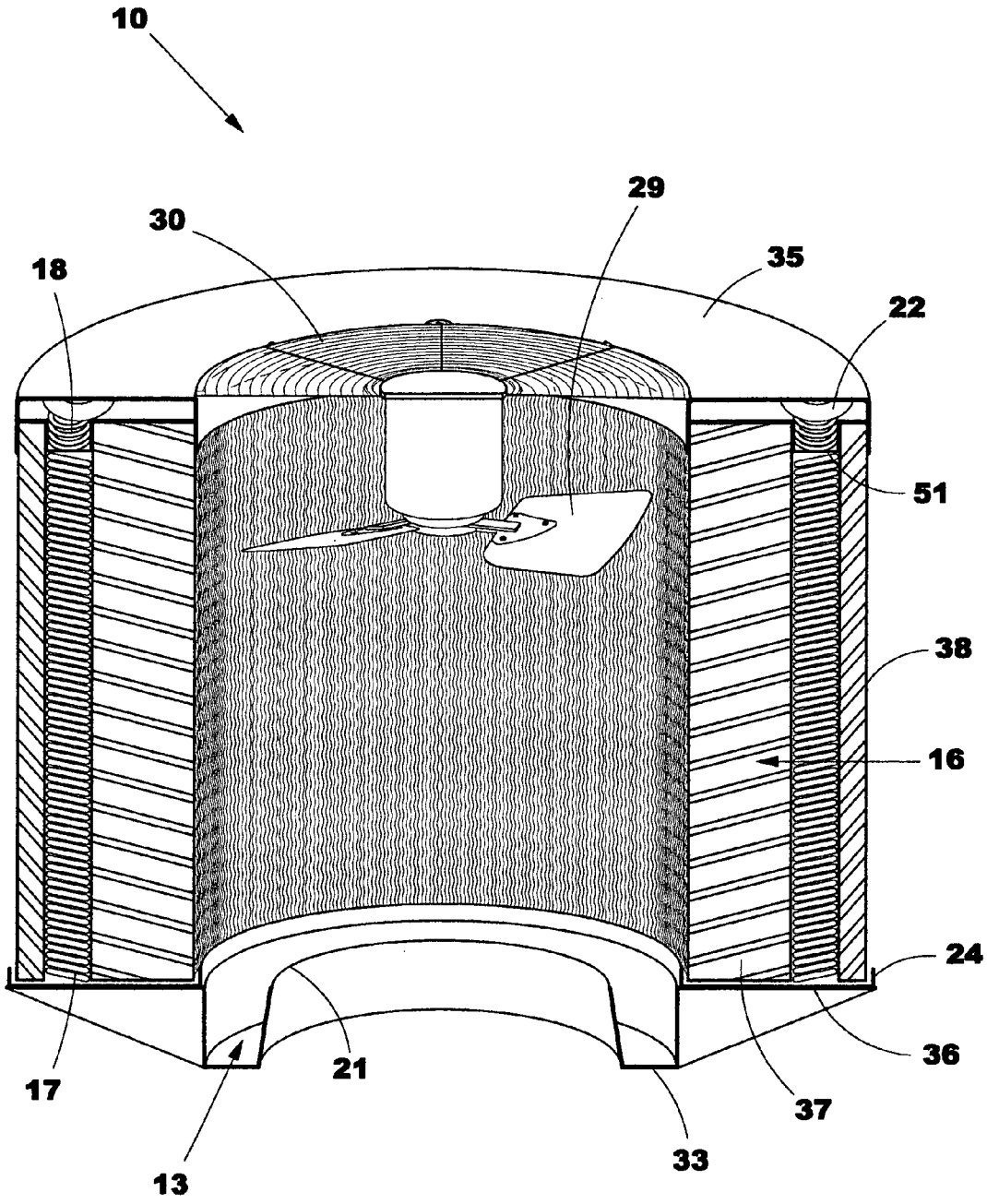
FIG. 17 shows a view of air conditioner system as a round unit with splash louver, condenser coils, and evaporative fill material

In FIG. 17 splash louver 18, condenser coils 17, and evaporative fill material means 16 make up the entire outside wall of air conditioning unit means 10 when they are formed into a round or oval shape. In this setup the walls of air conditioning unit means 10 are shaped in a cylinder form and splash louver means 18, condenser coils means 17, and evaporative fill material 16 make one continuous round outside wall around air conditioning unit means 10. In this shape, as with the horseshoe shape, there is more surface area of all three components splash louver means 18, condenser coils means 17, and evaporative fill material means 16 to increase the amount that the water and condenser coils means 17 are cooled.

While the above detailed description describes a preferred embodiment and best mode of the invention, it, should be understood and apparent to those skilled in the art that various other embodiments of the invention can be created without departing from the spirit and scope of the invention, which is defined in the claims that follow.

I claim:

1. A heat transfer system for an air conditioning refrigerant unit comprising:

a) a generally vertically disposed condenser coil means and a fan means for providing air cross flow through the condenser coil means;

b) water pump means to supply water to a water distribution means at the top of the coil means to flow water down the condenser coil means to cool said condenser coils means;

c) a splash louver means and an evaporative fill material means for allowing flowing of air through the splash louver means, the condenser coil means and the evaporative fill material means to retain the cooling water on the condenser coil means and within the system and increase cooling; and d) sump means for water storage and supply for said water pump and for receiving the water flowing down the condenser coil means for recycling.

2. A heat transfer system for an air conditioning refrigerant unit, wherein said heat transfer system is an attachment for replacing the condensing coils of an existing unit air cooled condenser coil means, comprising:

a) a generally vertically disposed condenser coil means and a fan means for providing air cross flow through the condenser coil means;

b) water pump means to supply water to a water distribution means at the top of the coil means to flow water down the condenser coil means to cool said condenser coils means;

c) a splash louver means and an evaporative fill material means for allowing flowing of air through the splash louver means, the condenser coil means and the evaporative fill material means to retain the cooling water on the condenser coil means and within the system and increase cooling; and d) sump means for water storage and supply for said water pump and for receiving the water flowing down the condenser coil means for recycling.

3. The heat transfer unit of claim 2, wherein:

said condenser coil means having a plurality of coiled copper pipes which expand and contract with temperature changes to release accumulated mineral deposits from the cooling water.

4. The heat transfer unit of claim 2, further comprising:

a plurality of vanes on said vertically extending splash louver to direct airflow though the said condenser coil means and cooling water back on to the condenser coil means.

5. The heat transfer unit of claim 2, further comprising:

a plurality of flow channels on said vertically upright evaporative fill material to direct air flow though said condenser coil means.

6. The heat transfer unit of claim 1, wherein:

said distribution means having a plurality of openings for distributing water over said condenser coil means.

7. The heat transfer unit of claim 5, wherein:

said distribution means extending along the upper portion of the condenser coil means to lower the height of said air conditioning refrigerant unit compared to cooling said condenser coil means with spray nozzles.

8. The heat transfer unit of claim 1, further comprising:

a flush pump means to periodically drain the sump means to get rid of accumulated water mineral deposits.

9. The heat transfer unit of claim 2, wherein:

said splash louver means, evaporative fill material means, and condenser coil means having a horseshoe shape.

10. The heat transfer unit of claim 2, wherein:

said splash louver means, evaporative fill material means, and condenser coil means comprise opposed separate units to make a double inlet for said air conditioning unit means.

11. The heat transfer unit of claim 10, wherein:

said opposed splash louver means, evaporative fill material means, and condenser coil means comprise multiple coil sections linked together.

12. The heat transfer unit of claim 2, wherein:

said splash louver means, evaporative fill material means, and condenser coil means having a round shape.

13. A method for providing heat transfer for an air conditioning refrigerant unit comprising the steps of:

a) flowing air through a generally vertically disposed condenser coil means with a fan means for providing air cross flow through the condenser coil means;

b) supplying water to a water distribution means at the top of the coil means to flow water down the condenser coil means to cool said condenser coils means;

c) retaining the cooling water on the condenser coil means and within the system and increasing the cooling with a splash louver means and an evaporative fill material means for allowing flowing of air through the splash louver means, the condenser coil means and the evaporative fill material means; and d) receiving the water flowing down the condenser coil means in a sump means for recycling.

14. A method of providing heat transfer for an existing air conditioning refrigerant unit, by replacing its condensing coil means with an attachment, comprising the steps of:

a) flowing air through a generally vertically disposed condenser coil means with a fan means for providing air cross flow through the condenser coil means;

b) supplying water to a water distribution means at the top of the coil means to flow water down the condenser coil means to cool said condenser coils means;

c) retaining the cooling water on the condenser coil means and within the system and increasing the cooling with a splash louver means and an evaporative fill material means for allowing flowing of air through the splash louver means, the condenser coil means and the evaporative fill material means; and d) receiving the water flowing down the condenser coil means in a sump means for recycling.

15. The heat transfer unit of claim 14, comprising the steps of:

expanding and contracting a plurality of coiled copper pipes on said condenser coil means temperature changes to release accumulated mineral deposits from the cooling water.

16. The heat transfer method of claim 14, comprising the steps of:

directing airflow though the said condenser coil means and cooling water back on to the condenser coil means with a plurality of vanes on said vertically extending splash louver.

17. The heat transfer method of claim 14, further comprising:

directing air flow though said condenser coil means with a plurality of flow channels on said vertically upright evaporative fill material.

18. The heat transfer method of claim 13, comprising the steps of:

distributing water over said condenser coil means through a plurality of openings in said distribution means.

19. The heat transfer method of claim 14, comprising the steps of:

periodically draining the sump means with a flush pump means to get rid of accumulated water mineral deposits.

* * * * *